US005776033A

United States Patent [19]

Brown

[11] Patent Number: 5,776,033

[45] Date of Patent: Jul. 7, 1998

[54] CHIN-UP BAR

[76] Inventor: William R. Brown, 4815 W. 61st Ter., Mission, Kans. 66205

[21] Appl. No.: 770,727

[22] Filed: Dec. 19, 1996

[51] Int. Cl.[6] ..... A63B 1/00; F16H 21/44; A47H 1/10; B65G 7/12

[52] U.S. Cl. ..... 482/40; 482/904; 74/98; 248/317; 294/16

[58] Field of Search ..... 482/904, 38, 39, 482/40; 248/324, 317, 316.5; 294/16, 106; 74/98

[56] References Cited

U.S. PATENT DOCUMENTS

| | | | |
|---|---|---|---|
| D. 210,469 | 3/1968 | Sejerson | D21/191 |
| D. 297,957 | 10/1988 | Gordon, III . | |
| 1,126,857 | 2/1915 | Platt | 482/24 |
| 1,956,502 | 3/1934 | Galatowitsch | 248/317 X |
| 3,097,875 | 7/1963 | Kaplan | 294/106 X |
| 3,414,910 | 12/1968 | Provi | 294/16 X |
| 3,430,953 | 3/1969 | Teetor | 482/40 |
| 3,716,232 | 2/1973 | Johnson et al. | 482/40 |
| 3,944,219 | 3/1976 | LoPresti . | |
| 4,018,437 | 4/1977 | LoPresti . | |
| 4,111,414 | 9/1978 | Roberts . | |
| 4,116,434 | 9/1978 | Bernstein . | |
| 4,182,509 | 1/1980 | Chupp, Jr. . | |
| 4,185,816 | 1/1980 | Bernstein . | |
| 4,230,313 | 10/1980 | Chupp, Jr. . | |
| 4,258,895 | 3/1981 | Rorie | 248/317 X |
| 4,662,629 | 5/1987 | Plovie . | |
| 4,923,194 | 5/1990 | Montgomery . | |
| 4,941,659 | 7/1990 | Silvestri . | |
| 4,949,956 | 8/1990 | Pobran . | |
| 5,322,489 | 6/1994 | Webb et al. . | |
| 5,372,556 | 12/1994 | Ropp . | |
| 5,389,055 | 2/1995 | Gangloff . | |
| 5,411,453 | 5/1995 | Wilson . | |
| 5,417,628 | 5/1995 | Vanderbleek | 482/904 X |
| 5,499,959 | 3/1996 | Holmes et al. . | |
| 5,556,369 | 9/1996 | Roberts . | |

FOREIGN PATENT DOCUMENTS

| | | | |
|---|---|---|---|
| 0015618 | 4/1903 | Sweden | 482/40 |
| 0039718 | 12/1915 | Sweden | 482/40 |
| 10738 | of 1901 | United Kingdom | 482/38 |

*Primary Examiner*—Richard J. Apley
*Assistant Examiner*—William LeMarca
*Attorney, Agent, or Firm*—Wm. Bruce Day

[57] ABSTRACT

A removable chin-up bar arrangement includes spaced body members situated at opposite ends of a chin-up bar extending therebetween, the bar being rotatable with respect to the body members. Opposed pincher members are swingably attached to each of the body members and are adapted to extend about and hang the body members and the chin-up bar from and overhead support, such as the framing extending about an interior doorway. A gear tooth lock mechanism extending between the ends of the chin-up bar and each of the pincher members, the lock mechanism moving the pincher members in unison toward each other and causing the chin-up bar to rotate in a first direction and upon rotation of the bar in the opposite direction causes the pincher members to open from each other, permitting removal of the chin-up bar arrangement from the doorway.

4 Claims, 2 Drawing Sheets

CHIN-UP BAR

FIELD OF THE INVENTION

The present invention relates to exercise devices and more particularly, to portable devices mounted about a door and useful as a chin-up bar.

BACKGROUND OF THE INVENTION

Many devices have been used to facilitate physical exercise. It is natural that an inventor would look to a doorway as an area to position a chin-up bar for exercise. Various devices on the market include telescoping bars which jam against the opposite sides of a doorway frame and cantilevered bars which jut out from a door. None of these are entirely satisfactory; some can tend to slip off during use and others are bulky and take up excessive storage space when not in use.

SUMMARY OF THE INVENTION

The present invention is directed to a removable chin-up bar arrangement which has spaced body members situated at opposite ends of a chin-up bar extending therebetween. The bar is rotatable with respect to the body members. A pair of opposed pincher members are swingably attached to each of the body members and are adapted to extend about and hang the body members and the chin-up bar from an overhead support, such as the framing about a doorway. A gear tooth lock mechanism extends between the ends of the chin-up bar and each of the pincher members and tends to move the pincher members in unison toward each other and causes the chin-up bar to rotate in a first direction. When the person removes his/her weight from the chin-up bar, rotation of the bar in the opposite direction causes the pincher members to open from each other to facilitate removal of the chin-up bar arrangement from the doorway overhead.

OBJECTS OF THE INVENTION

The objects of the present invention are to provide a new and improved chin-up bar arrangement; to provide such a chin-up bar arrangement which is securely attached to a doorway and is easily removable therefrom; to provide such a chin-up bar arrangement which is compact and easily stored; to provide such a chin-up bar arrangement which is particularly sturdy in use and is able to withstand the weight of a person exercising thereon; and to provide such a chin-up bar arrangement which is economical of manufacture and particularly well suited for the intended purpose.

Further objects and advantages of this invention will become apparent from the following description taken in connection with the drawings and illustrative embodiment of the invention.

DESCRIPTION OF THE PREFERRED EMBODIMENT

Figure 1:
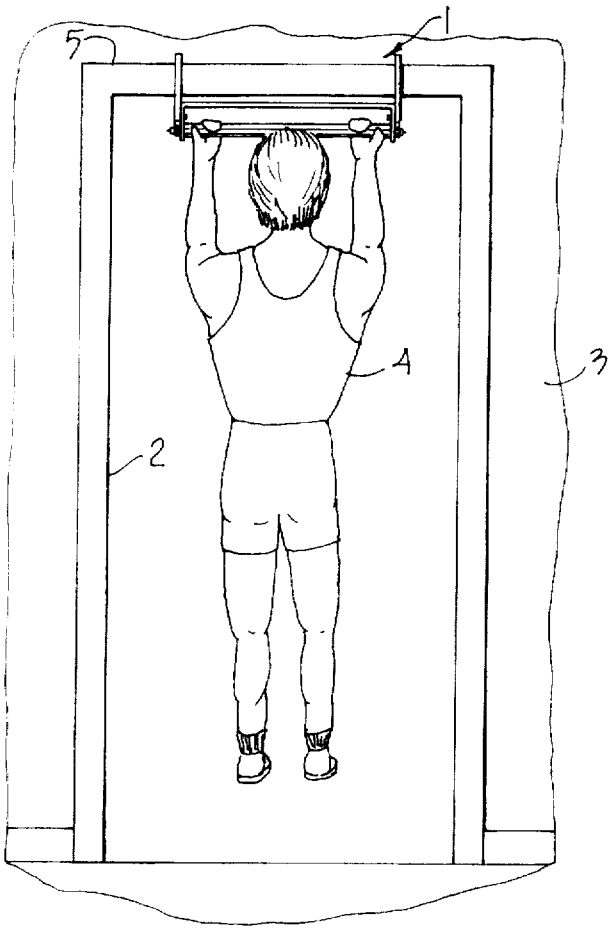
FIG. 1 is an elevational view showing the chin-up bar arrangement of the present invention suspended in the doorway and with a person doing chin-ups thereon.
Figure 2:
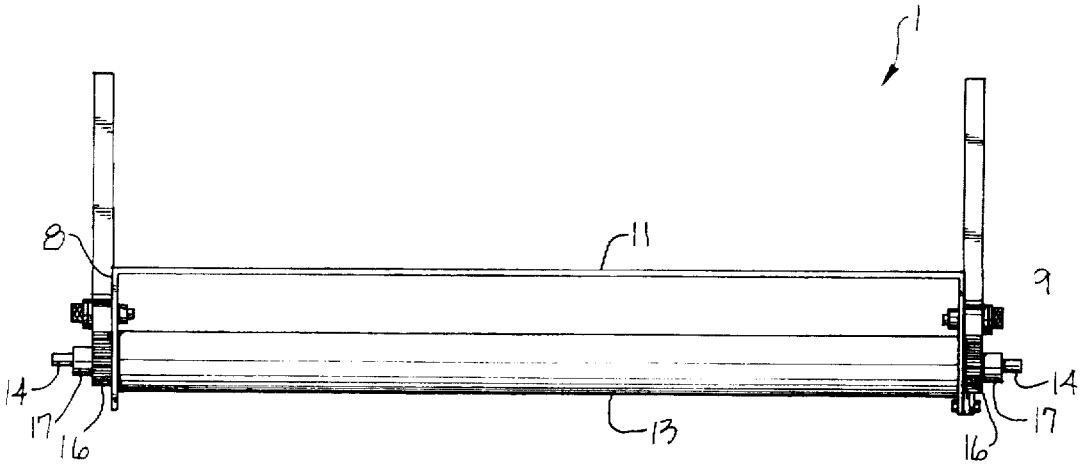
FIG. 2 is a front elevational view of the chin-up bar arrangement.
Figure 4:
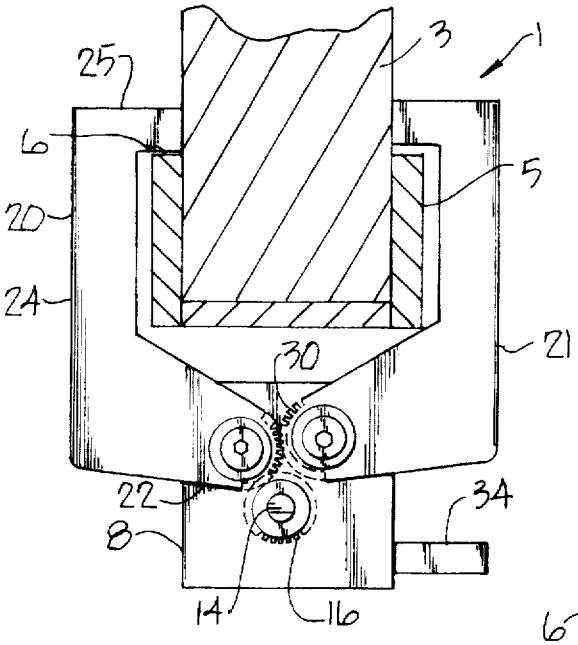
FIG. 4 is an end elevational view of the chin-up bar arrangement taken from one end thereof and showing the pincher members closed about a door overhead frame.
Figure 5:
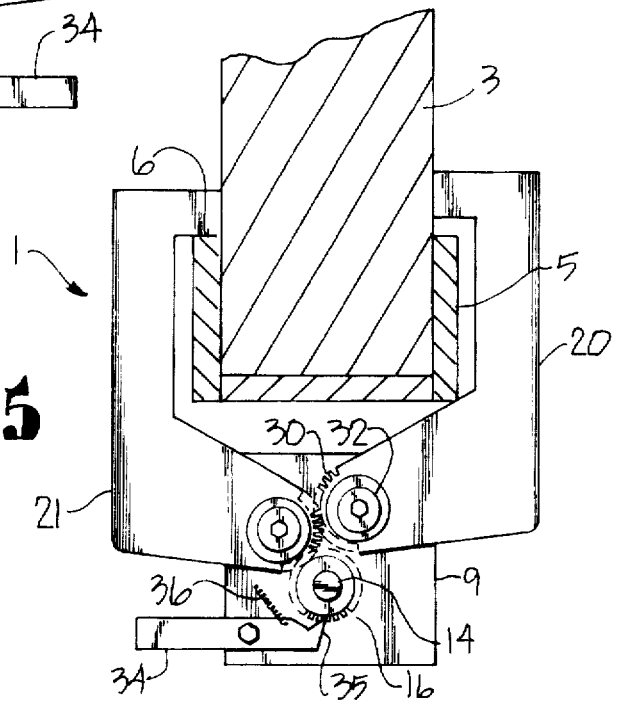
FIG. 5 is an end elevational view of the chin-up bar arrangement taken from the reverse end as shown in FIG. 4 and showing the chin-up bar arrangement attached about a doorway frame.

The reference numeral 1, FIG. 1, designates a chin-up bar arrangement according to the present invention. As shown in FIG. 1, the chin-up bar arrangement 1 is mounted within a doorway 2 of a building 3 in position for a person 4 to exercise thereon. Particularly, the chin-up bar arrangement 1 is adapted to be removably suspended from the overhead molding or framing 5 of the doorway opening. As shown in FIGS. 4 and 5, such framing 5 typically provides an upper shoulder 6 at the top of the framing 5.

Figure 3:
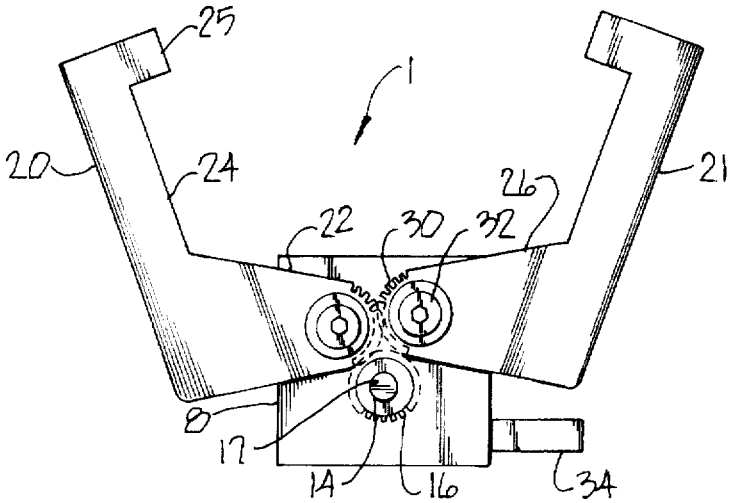
FIG. 3 is an end elevational view showing pincher members of the chin-up bar arrangement in an open relationship.

The chin-up bar arrangement 1 is generally formed of spaced body members 8 and 9 which are generally rectangular in form and, in the illustrated example, connected by an elongate bracket 11 extending between and supporting the body members 8 and 9. An elongate, cylindrical chin-up bar 13 extends between the body members 8 and 9 and has a non-skid rubberized slip cover or other roughened surface to provide a grip for the athlete. Spindles 14 on opposite ends of the chin-up bar 13 protrude through the body members 8 and 9 and terminate in gear wheels 16 fixed to the spindles 14, as by keys (not shown) and locked by end collars 17. The chin-up bar 13 extends through body members 8 and 9 generally at a lower portions of the respective body members 8 and 9. Spaced upwardly therefrom are the attachment points of opposed pincher members 20 and 21, there being pincher members 20 and 21 associated with each of the body members 8 and 9. In the illustrated example, the pincher members 20 and 21 are attached to the outside of the body members 8 and 9 rather than to the inside, adjacent the chin-up bar 13. Each of the pincher members 20 and 21 consists of a somewhat U-shaped member with a distal end 22 swingably attached to the respective body member 8 or 9, a linearly extending mid section 24 and a remote or termination end L-shaped finger 25. As shown in FIGS. 3, 4 and 5, the mid section 24 and finger 25 is proportioned and dimensioned to extend over the framing 5 with the finger 25 resting upon the framing upper shoulder 6. A thickened gusset section 26 provides strength between the mid section 24 and the distal end 22. The distal ends 22 terminate in gear segments 30. The pincher members 20 and 21 are swingably or pivotally attached to the body members 8 and 9 by axle bolts 32 which are positioned generally above and on either side of the chin-up bar spindle 14 so as to generally form an arrangement. The axle bolt 32 of the pincher member 21 is positioned slightly above that of the pincher member 20 so as to slightly space the gear segment 30 of the pincher member 21 from engagement with the chin-up bar spindle gear wheel 16. The spindle gear wheel 16 is in intermeshing engagement with the gear segment 30 of the pincher member 20 and the gear segments 30 of the pincher members 20 and 21 are in respective intermeshing engagement with each other; therefore, rotation of the gear segments 30 cause the pincher members 20 and 21 to open and close with respect to each other and simultaneously cause rotation of the chin-up bar 13 and vice versa.

As shown in FIG. 5, a locking pawl or dog 34 may be mounted on one of the body members 8 and 9 with a chisel tip 35 locking tooth of the gear wheel 16. The locking pawl 34 is preferably spring loaded 36 to an engaged position.

In use, the chin-up bar 13 is rotated in a first direction to open the pincher members 20 and 21 as shown in FIG. 3. The chin-up bar arrangement 1 is then lifted into position adjacent the top overhang of a doorway 2 and the chin-up bar 13 rotated in a second direction to close the pincher members 20 and 21 about the framing 5. The locking pawl 34 selectively ratchets and holds the pincher members 20 and 21 in a locked or closed position. The person 4 then proceeds to exercise. To remove the chin-up bar arrangement 1 from the doorway 2, the procedure is reversed. The locking pawl 34 is swung out of the way and the chin-up bar 13 rotated in the opposite direction to open the pincher members 20 and 21, thereby permitted lowering of the chin-up bar arrangement 1 from the doorway and subsequent storage.

Other embodiments of this invention will become apparent from the foregoing detailed description and the present invention is not to be taken as limited to any particular embodiment except insofar as set forth in the following claims.

What is claimed and desired to be secured by Letters Patent is as follows:

1. A removable chin-up bar arrangement comprising:

a) spaced body members situated at opposite ends of a chin-up bar extending therebetween; said bar being rotatable with respect to said body members;

b) a pair of opposed pincher members swingably attached to each of said body members and adapted to extend about and hang said body members and said chin-up bar from an overhead support;

c) a gear tooth lock mechanism extending between said ends of said chin-up bar and each of said pincher members, said lock mechanism, upon rotation of said bar in a first direction causing said pincher members to move toward each other and upon rotation of said chin-up bar in an opposite direction causing said pincher members to open from each other.

2. A removable chin-up bar arrangement for fitting about the frame of a doorway and comprising:

a) spaced body members situated at opposite ends of a chin-up bar extending therebetween, said bar being rotatable with respect to said body members;

b) a pair of opposed pincher members swingably attached to each of said body members, said pincher members having arm members generally in the shape of an inverted L with remote and distal arm ends and adapted to extend about a frame of a doorway and hang said body members and said chin-up bar therefrom;

c) a gear tooth lock mechanism extending between said ends of said chin-up bar and each of said pincher members and including intermeshing gear teeth in said distal arm ends and at an end of said chin-up bar, said lock mechanism moving said pincher members in unison toward each other upon rotation of said chin-up bar in a first direction and upon rotation of said chin-up bar in an opposite direction causing said pincher members to open from each other.

3. The chin-up bar arrangement set forth in claim 2 wherein said gear teeth in said pincher member distal arm ends are intermeshed and said gear teeth in only one of said pincher arms is intermeshed with said gear teeth in said end of said chin-up bar.

4. The chin-up bar arrangement set forth in claim 2 including a locking pawl selectively locking said gear tooth lock mechanism.

* * * * *